US012648655B2

(12) United States Patent
Benich et al.

(10) Patent No.: US 12,648,655 B2
(45) Date of Patent: Jun. 9, 2026

(54) COLLAPSIBLE PLAY YARD FRAME AND ASSOCIATED PLAY YARD

(71) Applicant: BABY TREND, INC., Fontana, CA (US)

(72) Inventors: Matthew R. Benich, Montclair, CA (US); Michael T. Cavins, Fontana, CA (US)

(73) Assignee: BABY TREND, INC., Fontana, CA (US)

( * ) Notice: Subject to any disclaimer, the term of this patent is extended or adjusted under 35 U.S.C. 154(b) by 65 days.

(21) Appl. No.: 18/508,821

(22) Filed: Nov. 14, 2023

(65) Prior Publication Data

US 2024/0188729 A1 Jun. 13, 2024

Related U.S. Application Data

(60) Provisional application No. 63/431,044, filed on Dec. 8, 2022.

(51) Int. Cl.
*A47D 13/06* (2006.01)

(52) U.S. Cl.
CPC ..... *A47D 13/063* (2013.01)

(58) Field of Classification Search
CPC .... A47D 13/06; A47D 13/061; A47D 13/063; A47D 13/065
See application file for complete search history.

(56) References Cited

U.S. PATENT DOCUMENTS

| | | | | |
|---|---|---|---|---|
| 5,279,006 | A * | 1/1994 | Teng | A47D 13/063 5/98.1 |
| 5,446,931 | A * | 9/1995 | Wei | A47D 13/063 5/98.1 |
| 6,421,850 | B1 * | 7/2002 | Welsh, Jr. | A47D 13/063 5/98.1 |
| 11,369,211 | B2 | 6/2022 | Mountz | |
| 2006/0021138 | A1 * | 2/2006 | Waldman | A47D 13/063 5/99.1 |
| 2007/0017025 | A1 * | 1/2007 | Myer | A47D 7/002 5/99.1 |

(Continued)

FOREIGN PATENT DOCUMENTS

| | | | | |
|---|---|---|---|---|
| DE | 102018219509 | A1 * | 5/2019 | A47D 13/061 |

*Primary Examiner* — David E Sosnowski
(74) *Attorney, Agent, or Firm* — Thompson Hine LLP

(57) ABSTRACT

A collapsible play yard frame includes a plurality of frame members interconnected such that the frame is movable between a use configuration and a collapsed configuration. The plurality of frame members form a base segment with a locking hub that is movable between a raised frame unlock position and a lowered frame lock position; corner supports extending upward from the base segment; and a set of upper rails. A biasing assembly is located externally of the locking hub, for biasing the locking hub toward the raised frame unlock position during transition of the play yard frame from the collapsed configuration to the use configuration. The biasing assembly comprises at least one elastic component interconnecting at least two base frame members of the base segment, such that the elastic component stretches as the locking hub moves from the raised frame unlock position to the lowered frame lock position.

6 Claims, 8 Drawing Sheets

(56) References Cited

U.S. PATENT DOCUMENTS

| | | | | |
|---|---|---|---|---|
| 2007/0163041 | A1* | 7/2007 | Cheng | A47D 13/063 5/99.1 |
| 2008/0127412 | A1* | 6/2008 | Pleiman | A47D 13/063 5/99.1 |
| 2008/0189854 | A1* | 8/2008 | Thorne | A47D 13/061 5/99.1 |
| 2009/0260156 | A1* | 10/2009 | Yu | A47D 13/063 5/99.1 |
| 2012/0042920 | A1* | 2/2012 | Armstrong | E04H 15/003 135/153 |
| 2012/0248394 | A1 | 10/2012 | Thorne | |
| 2013/0160205 | A1* | 6/2013 | Dowd | A47D 13/063 5/99.1 |
| 2015/0151429 | A1* | 6/2015 | Thibodeaux | E01H 1/12 294/104 |
| 2016/0270557 | A1* | 9/2016 | Horst | A47D 13/063 |
| 2019/0142183 | A1* | 5/2019 | Mountz | A47D 13/063 5/99.1 |
| 2019/0335702 | A1* | 11/2019 | Thrift | E04H 15/48 |
| 2019/0350378 | A1* | 11/2019 | Schaffer | A47D 13/066 |
| 2020/0146465 | A1 | 5/2020 | Thorne | |
| 2020/0187673 | A1 | 6/2020 | Thorne | |
| 2021/0007509 | A1* | 1/2021 | Mountz | A47D 13/063 |
| 2021/0337983 | A1* | 11/2021 | Bastien | E05D 11/1007 |
| 2023/0031002 | A1* | 2/2023 | Mountz | A47D 13/063 |

* cited by examiner

COLLAPSIBLE PLAY YARD FRAME AND ASSOCIATED PLAY YARD

TECHNICAL FIELD

This application relates generally to collapsible frame assemblies for use in connection with play yards and, more specifically, to a collapsible play yard frame with a bias assembly for biasing the frame toward the setup and collapsed position.

BACKGROUND

Folding play yards are a standard item in parenting and baby caregiving. Such play yards enable a baby or toddler to play within a controlled and protected space. Play yards typically include a frame system and a plurality of flexible mesh/fabric panels to provide an enclosure. The frame system typically includes a plurality of frame members interconnected such that, when unfolded, form a base, upright corner posts and upper rails interconnecting the corner posts. The base includes a central locking hub interconnecting some base frame members, which in turn connect to the upright corner posts. Each upper rail is formed by two frame members that are pivotably connected to each other by a lockable connection located centrally along the length of the upper rail.

Applicable standards require that the lockable connection of each upper rail not function when the center locking hub is in its down position for play yard use. As a result, during play yard setup, the upper rails must be locked into their rigid use positions before the center locking hub is lowered. If the center locking hub is lowered before the upper rails are locked, then the rails cannot be locked for use.

One problem that occurs during setup is that, as the frame is unfolded, the center locking hub falls downward under gravity, before the user locks the upper rails. The user must, therefore, consciously hold the center locking hub upward during setup, making set up difficult. Likewise, during collapse of the frame from the use configuration to the storage configuration, the center locking hub can remain down longer than desired, resulting in certain frame components interfering with others in a manner that prevents the frame being fully collapsed to the storage configuration.

In one attempt to address the above issues, a center locking hub has been developed that includes an internal spring system for biasing the center locking hub upward. However, such a center locking hub is complex and costly to manufacture and produce.

Accordingly, it would be advantageous to provide a simple, effective biasing system for urging the center locking hub upward.

SUMMARY

In one aspect, a collapsible play yard frame includes a plurality of frame members interconnected such that the frame is movable between a use configuration and a collapsed configuration. The plurality of frame members include: a base segment comprising a plurality of base frame members, a multiplicity of the base frame members extending outward from a locking hub, the locking hub movable between a raised frame unlock position and a lowered frame lock position, the plurality of base frame members forming, at least partly, the base segment of the play yard frame when in the use configuration; a set of corner frame members extending upward from the base segment when the play yard frame is in the use configuration; and a set of upper rails that, in the use configuration, interconnect the corner frame members, each upper rail formed by a pair of upper frame members pivotably connected together by a lockable connection for holding the upper frame members in the use configuration. A biasing assembly is located on the play yard frame, externally of the locking hub, for biasing the locking hub toward the raised frame unlock position during transition of the play yard frame from the collapsed configuration to the use configuration.

In another aspect, a collapsible play yard frame includes a plurality of frame members interconnected such that the frame is movable between a use configuration and a collapsed configuration. The plurality of frame members form a base segment with a locking hub, the locking hub movable between a raised frame unlock position and a lowered frame lock position; corner supports extending upward from the base segment; and a set of upper rails. A biasing assembly is located on the play yard frame, externally of the locking hub, for biasing the locking hub toward the raised frame unlock position during transition of the play yard frame from the collapsed configuration to the use configuration. The biasing assembly comprises at least one elastic component interconnecting at least two base frame members of the base segment, such that the elastic component stretches as the locking hub moves from the raised frame unlock position to the lowered frame lock position.

The details of one or more embodiments are set forth in the accompanying drawings and the description below. Other features, objects, and advantages will be apparent from the description and drawings, and from the claims.

DETAILED DESCRIPTION

Figure 1:
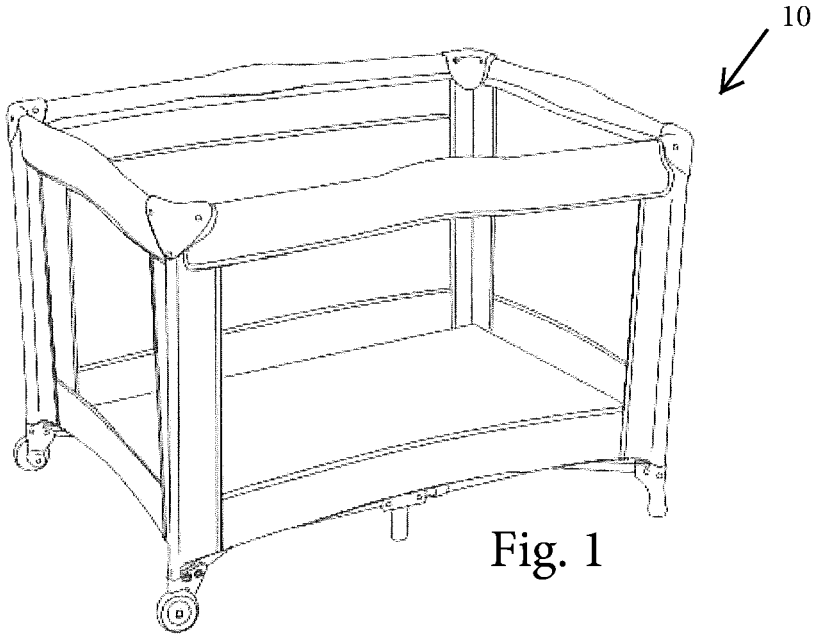
FIG. 1 shows a play yard in use configuration.
Figure 2:
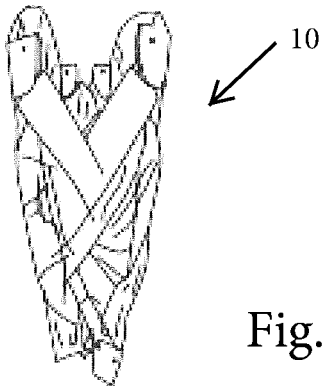
FIG. 2 shows the play yard in a collapsed, storage configuration.
Figure 3:
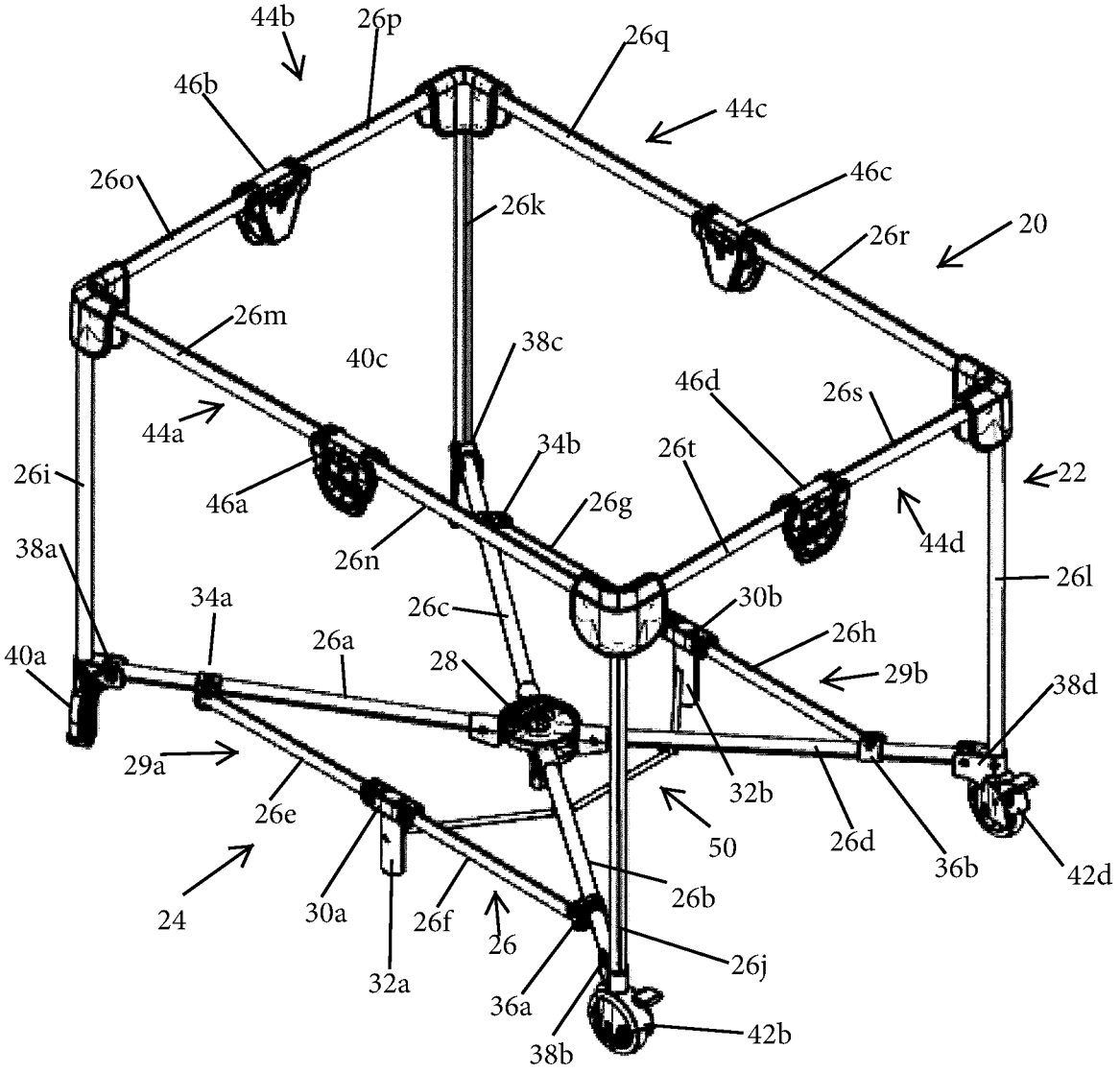
FIGS. 3-6 show views of a play yard frame when in the use configuration.
Figure 4:
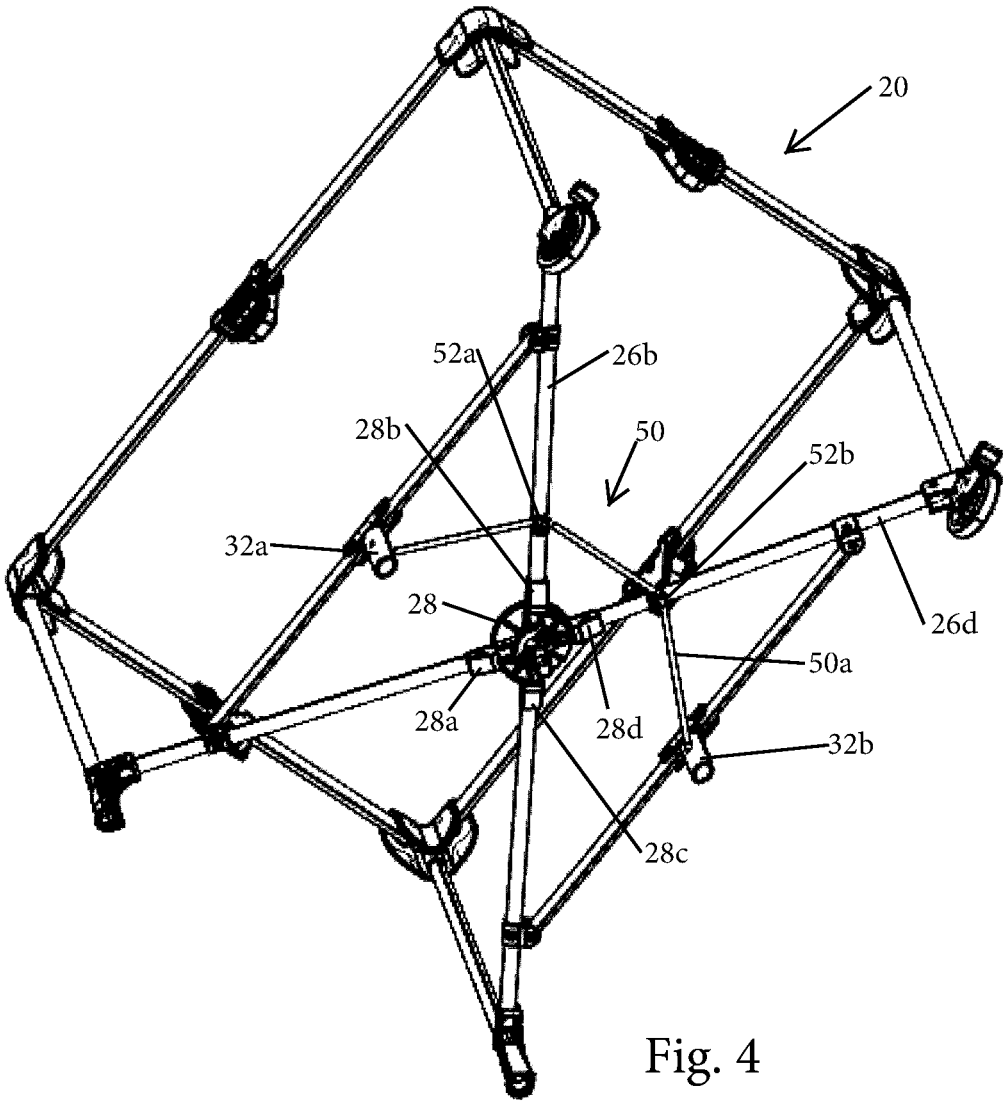
Figure 5:
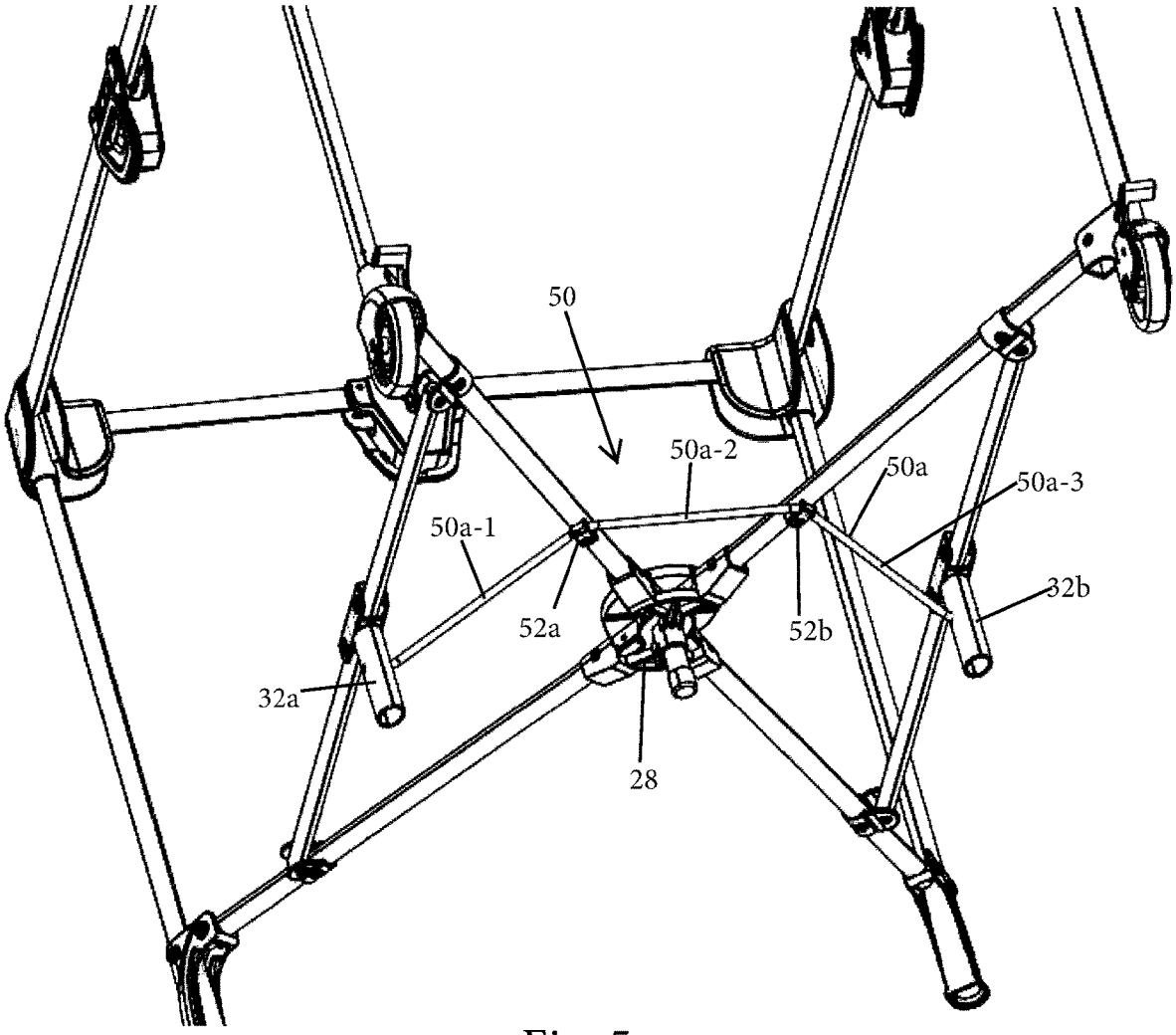
Figure 6:
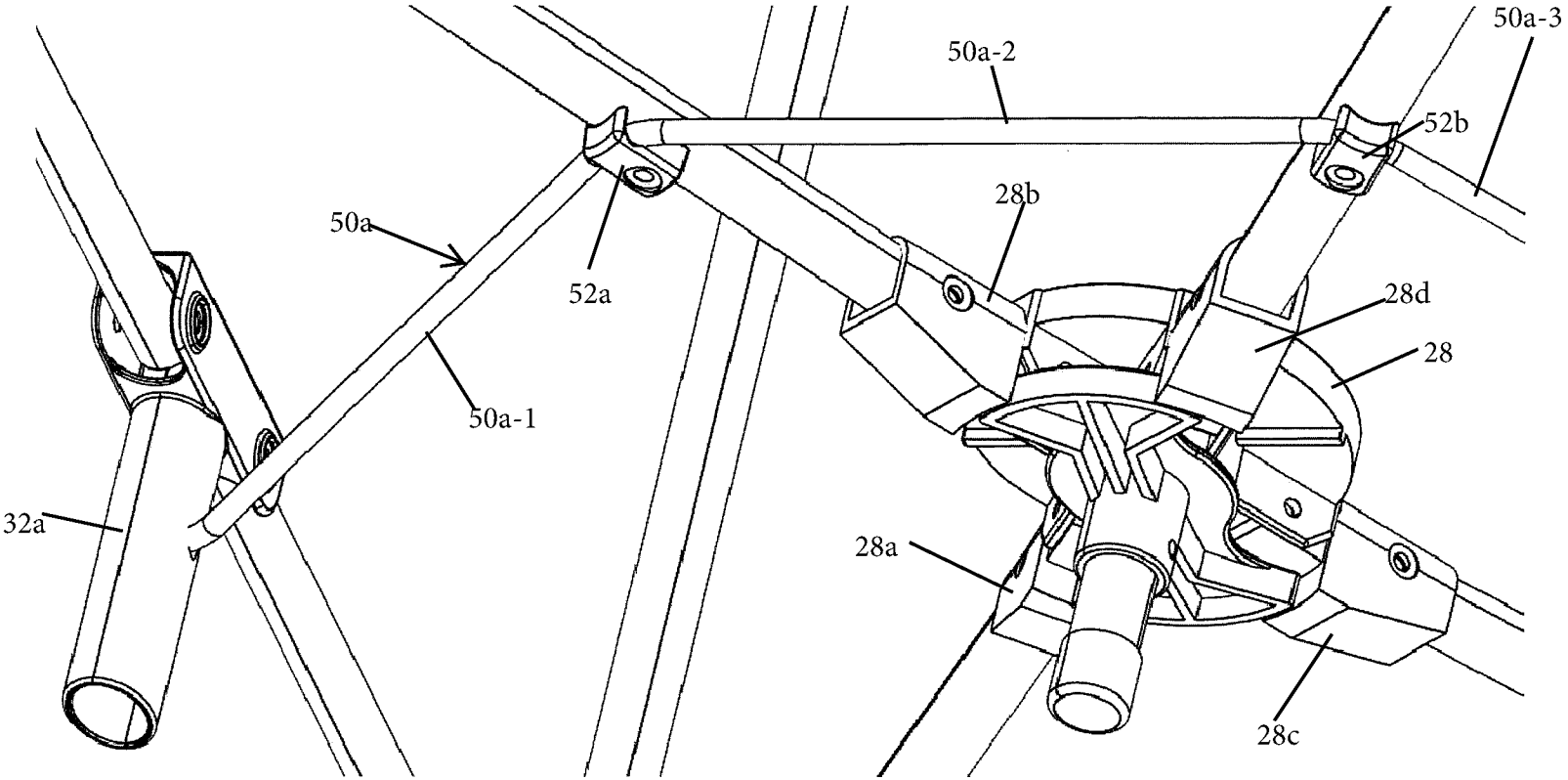

Referring to FIGS. 1 and 2, a play yard 10 includes an internal frame assembly that is at least partly covered by cloth, padding and/or mesh. The frame assembly enables the play yard to be moved between a use configuration, per FIG. 1, and a collapsed, storage configuration per FIG. 2. Referring to FIGS. 3-9, the play yard frame 20 is shown without its covering, and includes a plurality of frame members 22 (e.g., tubular metal or tubular plastic) interconnected such that the frame is movable between the use configuration and the collapsed configuration.

In the use configuration, the plurality of frame members include a base segment 24 comprising a plurality of base frame members 26, where base frame members **26*a*-26*d* extend outward from a locking hub 28 and are pivotable relative to the hub via pivotable hub brackets 28*a*-28*d*. The base segment also includes a forward base rail 29*a* comprising base frame members 26*e* and 26*f* that interconnect the base frame members 26*a* and 26*b*, and a rearward base rail 29*b* comprising base frame members 26*g* and 26*h* that interconnect the base frame members 26*c* and 26*d*. Base frame members 26*e* and 26*f* are pivotably connected to a forward bracket 30*a* that includes a downwardly extending supporting frame member 32***a*, and base frame members 26*g* and 26*h* are pivotably connected to a rearward bracket 30*b* that includes a downwardly extending supporting frame member 32*b*. The opposite ends of base frame members 26*e* and 26*f* are pivotably connected to intermediate portions of base frame members 26*a* and 26*b* by respective brackets 34*a* and 36*a*, and the opposite ends of base frame members 26*g* and 26*h* are pivotably connected to intermediate portions of base frame members 26*g* and 26*h* by respective brackets 34*b* and 36*b*.

Corner frame members 26*i*-26*l* extend upward from the base segment when the play yard frame is in the use configuration. The outer end of each base frame member 26*a*-26*d* is pivotably connected to one of the corner frame members 26*i*-26*l* by a respective corner bracket 38*a*-38*d*. Corner brackets 38*a*, 38*c* include downwardly extending support feet 40*a*, 40*c*, and corner brackets 38*b*, 38*d* include downwardly extending wheel units 42*b* and 42*d*.

Upper rails 44*a*-44*b* interconnect the corner frame members 26*i*-261, with each upper rail formed by a pair of upper frame members (26*m*, 26*n* and 26*o*, 26*p* and 26*q*, 26*r*, and 26*s*, 26*t*) that are pivotably connected together by respective lockable connections 46*a*-46*d* for holding the upper frame members in the use configuration.

Figure 7:
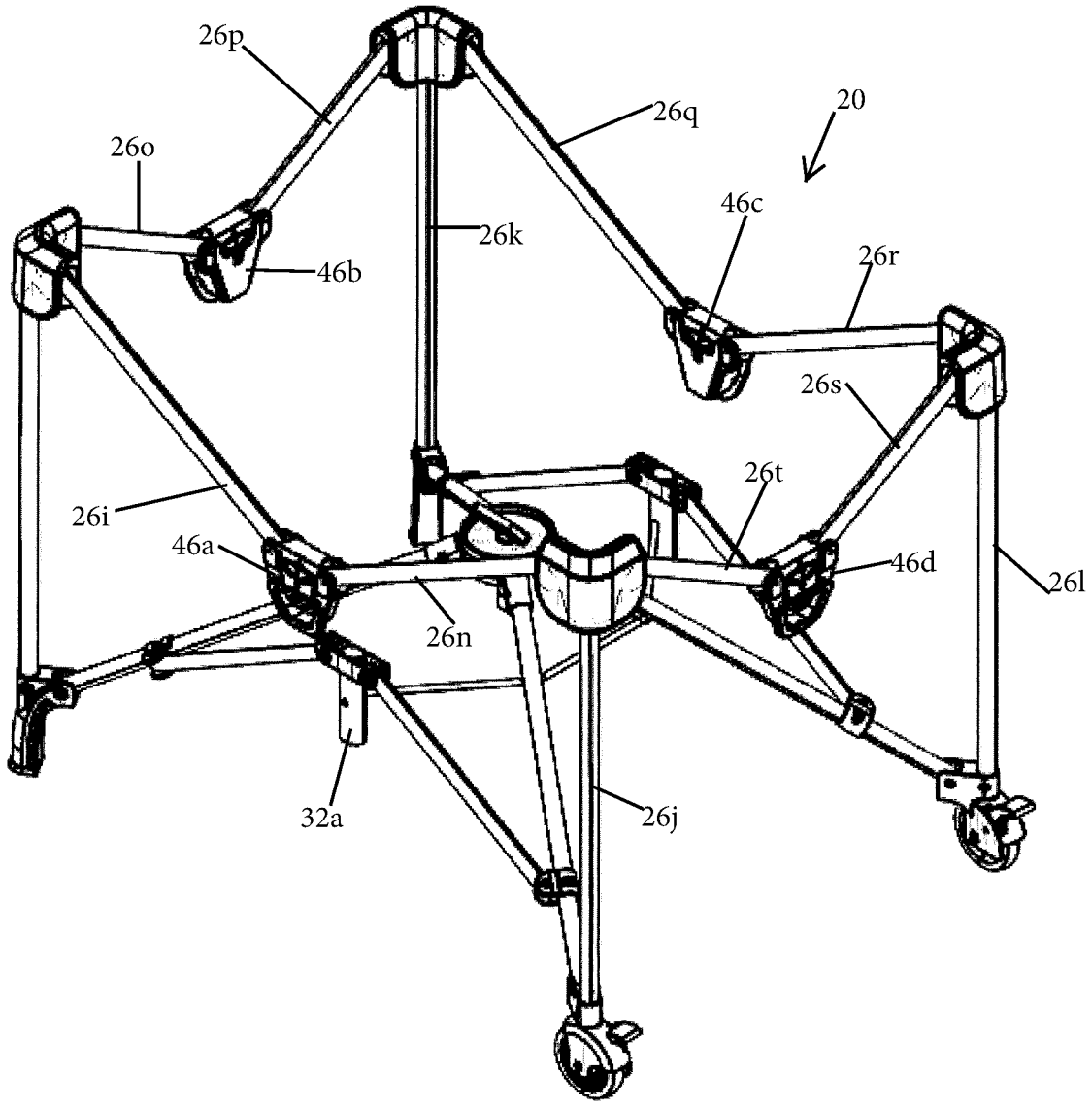
FIGS. 7-9 show views of the play yard frame in a transitional state between the use configuration and the collapsed configuration.
Figure 8:
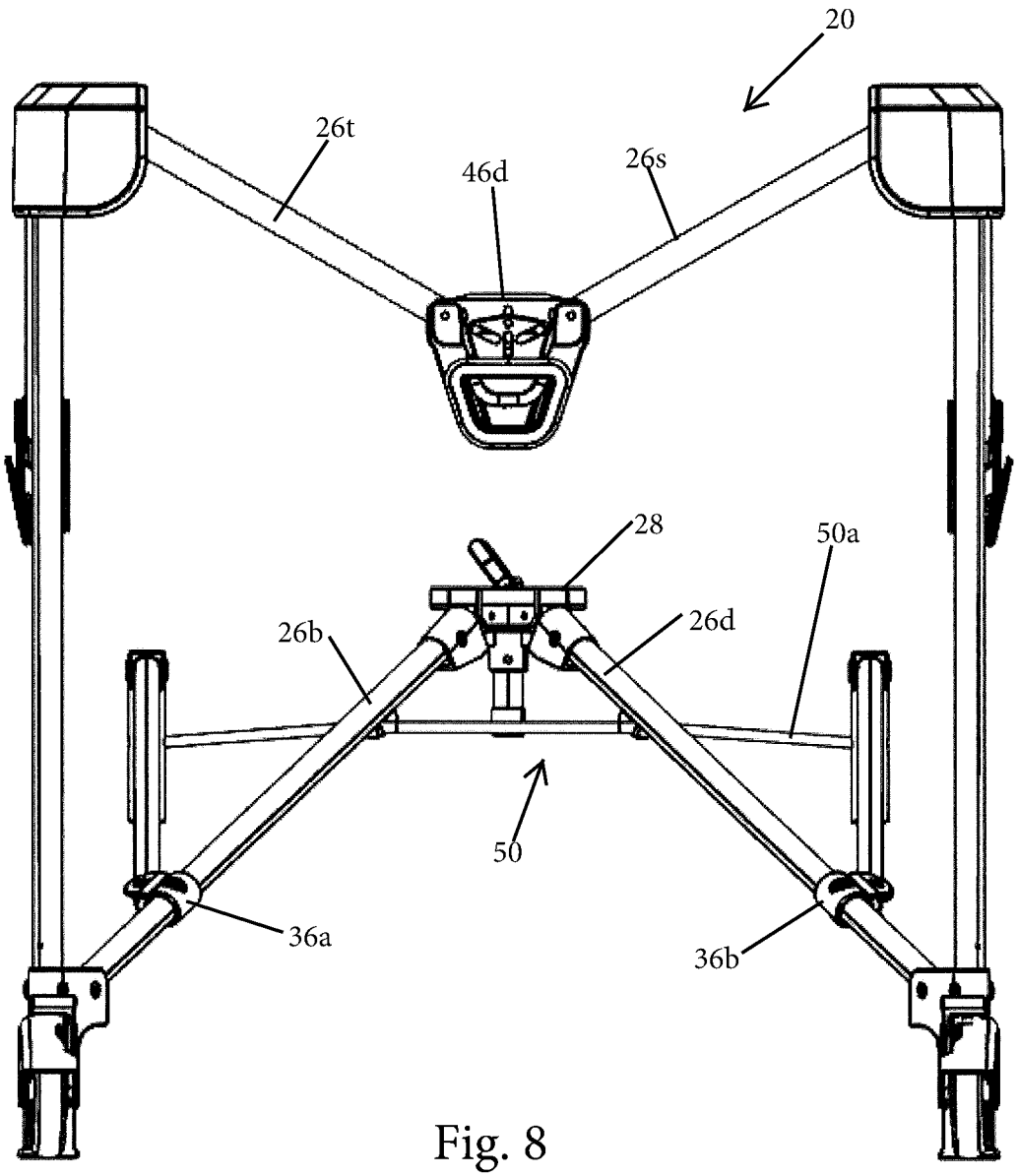
Figure 9:
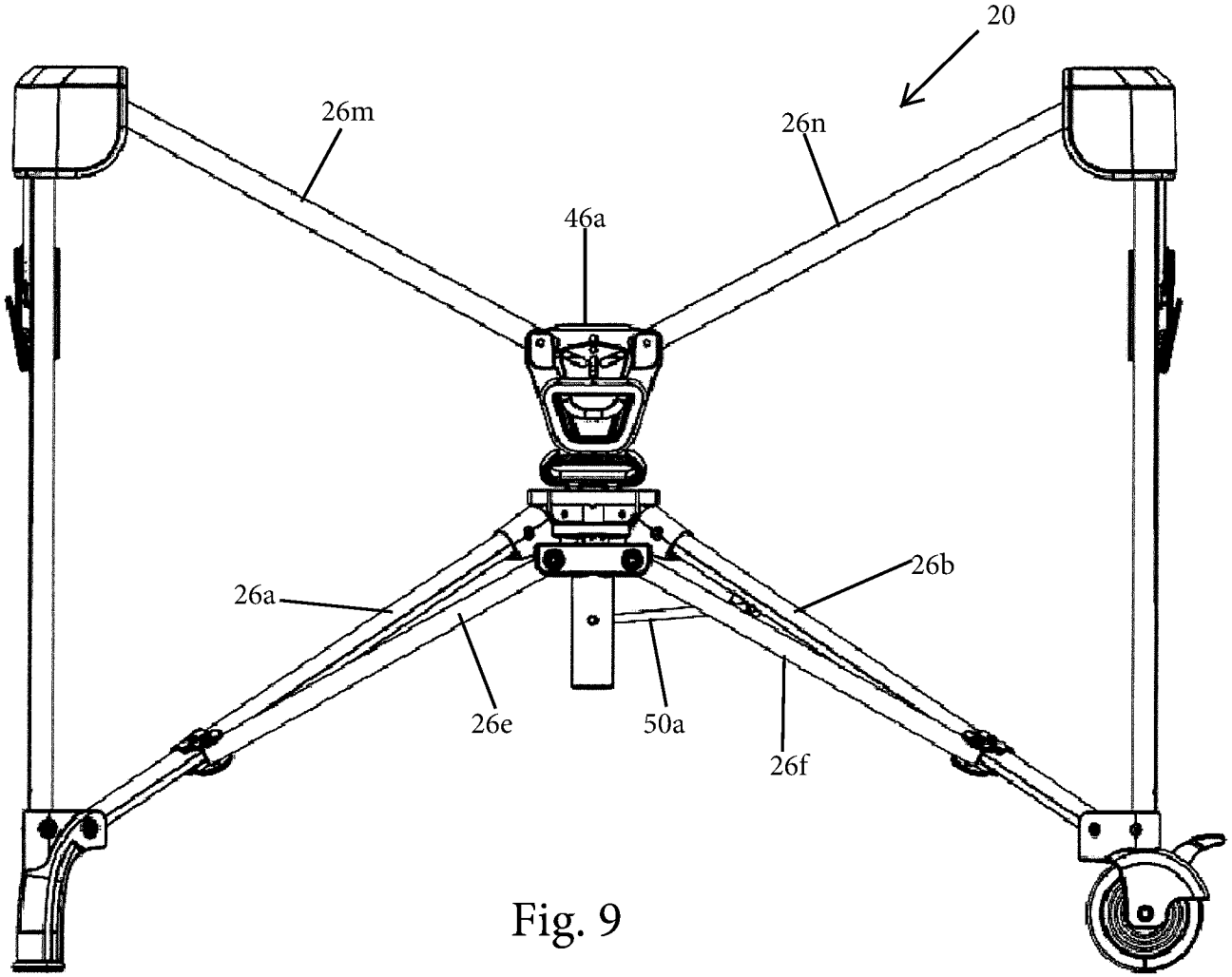

The locking hub 28 is movable between a lowered frame lock position, shown in FIGS. 3-6, and a raised frame unlock position, shown in FIGS. 7-9. As mentioned above, when the locking hub 28 is lowered, the lockable connections (top rail hinge locks) 46*a*-46*d* are not functional, but when the locking hub is raised, the lockable connections are functional. This relationship is achieved by the frame members inherent tolerance and slack that forces the top rail hinge locks to not function if the center locking hub is down and locked before the top rail hinge locks are locked, during setup. When the play yard frame is setup, the top rail hinge locks cannot disengage if the center locking hub is down and locked.

A biasing assembly 50 is located on the play yard frame, externally of the locking hub 28, for biasing the locking hub 28 toward the raised frame unlock position, particularly during transition of the play yard frame from the collapsed configuration to the use configuration, or transition of the frame from the use configuration to the collapsed configuration. Here, the biasing assembly comprises an elastic component 50*a*, engaged on the base segment such that the elastic component stretches as the play yard frame moves from the collapsed configuration to the use configuration. In one example, the elastic component could be comprised of a bungee cord. As an alternative to a bungee cord, the elastic component could be any suitably flexible material including monofilaments, rope, woven and twisted cord, plastic and textile tapes, ribbon, and those materials commonly called string. The elastic component 50*a* is secured to the supporting frame member 32*a* and the supporting frame member 32*b*, and extends through a bracket 52*a* located at an intermediate location of a length of the base frame member 26*b* and a bracket 52*b* located at an intermediate location along a length of the base frame member 26*d*. In one example, the brackets 52*a* and 52*b* tightly capture the segment of the elastic component passing therethrough (e.g., preventing the elastic component from moving through the brackets). In another embodiment, the brackets 52*a* and 52*b* only loosely capture the elastic component (e.g., allowing the elastic component to slide through the brackets). The tension placed on the elastic component 50*a* as it undergoes stretch tends to pull the base frame members together in a manner that urges the locking hub upward.

As mentioned above, the biasing assembly 50 biases the locking hub 28 toward the raised frame unlock position, particularly during transition of the play yard frame from the collapsed configuration to the use configuration, or transition of the frame from the use configuration to the collapsed configuration. Such biasing facilitates both play yard setup (e.g., the user does not have to hold the locking hub upward while at the same time trying to lock the upper rails) and play yard collapse (e.g., pulling the forward and rearward base rails inward during collapse to assure that they do not interfere with the upper rails during collapse). The biasing assembly is simple from the perspective of parts and manufacturing, yet very effective, and avoids the relatively high cost associated with incorporating a spring bias internally of the locking hub 28. Here, the elastic component is also sufficiently small and flexible so as to not interfere with collapse of the frame.

It is to be clearly understood that the above description is intended by way of illustration and example only, is not intended to be taken by way of limitation, and that other changes and modifications are possible. Although the described embodiment includes a single elastic component, multiple elastic components could be used. For example, three distinct elastic components could make up illustrated segments 50*a*-1, 50*a*-2 and 50*a*-3. Alternatively, two distinct elastic components 50*a*-1 and 50*a*-3 could be used, and segment 50*a*-2 eliminated. Still other variations are possible.

The invention claimed is:

1. A collapsible play yard frame, comprising:

a plurality of frame members interconnected such that the frame is movable between a use configuration and a collapsed configuration, the plurality of frame members including:

a base segment comprising a plurality of base frame members, a multiplicity of the base frame members extending outward from a locking hub, the locking hub movable between a raised frame unlock position when the play yard frame is in the collapsed configuration and a lowered frame lock position when the play yard frame is in the use configuration, the plurality of base frame members forming, at least partly, the base segment of the play yard frame when in the use configuration;

a set of corner frame members extending upward from the base segment when the play yard frame is in the use configuration;

a set of upper rails that, in the use configuration, interconnect the corner frame members, each upper rail formed by a pair of upper frame members pivotably connected together by a lockable connection for holding the upper frame members in the use configuration;

a biasing assembly comprising an elongated elastic component located on the base segment of the play yard frame, externally of the locking hub, wherein the elongated elastic component is connected to at least two of the plurality of base frame members and is configured to bias the locking hub toward the raised frame unlock position by being configured to move from a relaxed state to a stretched state during a transition of the play yard frame from the collapsed configuration to the use configuration.

2. The play yard frame of claim 1, wherein the elongated elastic component comprises a bungee cord.

3. The play yard frame of claim 1, wherein:

the multiplicity of base frame members comprising a first, second, third and fourth base frame member, each extending outward from the locking hub;

the plurality of base frame members further comprising:

a forward base rail comprising fifth and sixth base frame members, wherein the fifth base frame member is configured to interconnect the first base frame member and the and the sixth base frame member is configured to interconnect the second base frame member;

a rearward base rail comprising seventh and eighth base frame members, wherein the seventh base frame member is configured to interconnecting the third base frame member and the eighth base frame member is configured to interconnect the fourth base frame members; and wherein the elongated elastic component is secured to the forward base rail, the rearward base rail, the second base frame member, and the fourth base frame member.

4. The play yard frame of claim 3, wherein the play yard frame further comprises a first supporting frame member extending downward from the forward base rail, when in the use configuration, and a second supporting frame member extending downward from the rearward base rail, when in the use configuration; and wherein the elongated elastic component is secured to the first supporting frame member extending from the forward base rail, the second supporting frame member extending from the rearward base rail, and is configured to passes through a first bracket located at an intermediate location of a length of the second base frame member and a second bracket located at an intermediate location along a length of the fourth base frame member.

5. A play yard comprising the play yard frame of claim 1, wherein the play yard frame is at least partly covered in a fabric and/or mesh material.

6. A collapsible play yard frame, comprising:

a plurality of frame members interconnected such that the frame is movable between a use configuration and a collapsed configuration, the plurality of frame members forming:

a base segment comprising a plurality of base frame members and with a locking hub, the locking hub movable between a raised frame unlock position when the play yard frame is in the collapsed configuration and a lowered frame lock position when the play yard frame is in the use configuration;

corner supports extending upward from the base segment; and a set of upper rails;

a biasing assembly comprising an elongated elastic component located on the base segment of the play yard frame, externally of the locking hub, wherein the biasing assembly is connected to at least two of the plurality of base frame members and is configured to bias the locking hub toward the raised frame unlock position by elastically stretching during a transition of the play yard frame from the collapsed configuration to the use configuration, and wherein the elongated elastic component is configured to interconnect the at least two base frame members of the base segment, such that the elongated elastic component stretches as the locking hub moves from the raised frame unlock position to the lowered frame lock position.

* * * * *